US010358603B1

(12) United States Patent
Pour

(10) Patent No.: US 10,358,603 B1
(45) Date of Patent: Jul. 23, 2019

(54) METHOD FOR PRODUCING FUEL FROM PLASTIC OR RUBBER WASTE MATERIAL

(71) Applicant: Somayeh Shayesteh Pour, Qom (IR)

(72) Inventor: Somayeh Shayesteh Pour, Qom (IR)

( * ) Notice: Subject to any disclaimer, the term of this patent is extended or adjusted under 35 U.S.C. 154(b) by 0 days.

(21) Appl. No.: 15/897,124

(22) Filed: Feb. 14, 2018

(51) Int. Cl.

| | |
|---|---|
| ***C10G 1/10*** | (2006.01) |
| ***C10G 1/02*** | (2006.01) |
| ***C10G 1/00*** | (2006.01) |
| ***C10G 7/00*** | (2006.01) |

(52) U.S. Cl.
CPC ..... *C10G 1/10* (2013.01); *C10G 1/002* (2013.01); *C10G 1/02* (2013.01); *C10G 7/00* (2013.01); *C10G 2300/1003* (2013.01); *C10G 2300/30* (2013.01); *C10G 2300/80* (2013.01)

(58) Field of Classification Search
CPC ..... C10G 1/10
See application file for complete search history.

(56) References Cited

U.S. PATENT DOCUMENTS 5,811,606 A * 9/1998 Yang ..... C10G 1/002 585/241
6,107,532 A * 8/2000 Saito ..... C10G 1/10 44/300
2005/0148487 A1* 7/2005 Brownscombe ..... C10G 1/10 510/446
2011/0178358 A1* 7/2011 Kashimoto ..... B01J 21/063 588/320
2017/0327663 A1* 11/2017 Gil ..... B01J 19/245

OTHER PUBLICATIONS

The Engineering Toolbox (2003). Fuels—Densities and Specific Volume. [online] Available at: https://www.engineeringtoolbox.com/fuels-densities-specific-volumes-d_166.html (Year: 2003).*

* cited by examiner

*Primary Examiner* — Philip Y Louie
*Assistant Examiner* — Alyssa L Cepluch

(57) ABSTRACT

A method for producing fuels such as liquid and solid fuels from waste materials comprising rubber or plastic waste, is disclosed. The method comprises the steps of: (a) grounding said waste material into chips or flakes, (b) transferring the chips or flakes via a transmission system to a viscous fluid disorder tank, (c) introducing a catalyst to the transferred chips or flakes in the tank, (d) heating the chips or flakes with catalyst using a heating jacket or a coil in a reservoir of the tank at a predetermined temperature, (e) mixing the molten chips or flakes with catalyst using a helical butterfly stirrer inside the reservoir at a predetermined time and temperature to decompose the waste material, and (f) filtering the decomposed waste material to produce the fuel. This method is simple, quick and economical for producing different characteristics of fuel without any environmental lesions and contamination.

3 Claims, 7 Drawing Sheets

| No | Test Name | Unit | Result | Test method |
|---|---|---|---|---|
| 1 | Density @15°C | g/ml | **0.8149** | ASTM D 4052 |
| 2 | Viscosity @37.8°C | CSt | **1.8665** | ASTM D7042 |
| 3 | Cetan Index | - | **47.4** | ASTM D976 |
| 4 | Copper Corrosion 3h@100°C | - | **1a** | ASTM D130 |
| 5 | Flash Point | °C | **56.5** | ASTM D93 |
| 6 | Ash Content | mass% | **0.003** | ASTM D482 |
| 7 | Cloud Point | °C | **-10** | ASTM D2500 |
| 8 | Carbon Residue | mass% | **0.076** | ASTM D524 |

FIG. 6

| No | Test Name | Unit | Result | Test method |
|---|---|---|---|---|
| 1 | $P_{total}$ | kPa | **67.7** | ASTM D 5191 |
| 2 | Copper Corrosion 3h@50°C | - | **1a** | ASTM D130 |
| 3 | Gun Existent (air jet)* | Mg/100ml | **315.6** | ASTM D381 |
| 4 | Induction Period | min | **64.12** | ASTM D525 |
| 9 | **Distillation Range@760 mmHg** | | | ASTM D86 |
| | IBP | °C | **42.7** | " |
| | 5% Vol Recovery | | **52.7** | " |
| | 10% Vol Recovery | | **56.5** | " |
| | 15% Vol Recovery | | **59.4** | " |
| | 20% Vol Recovery | | **61.8** | " |
| | 30% Vol Recovery | | **66.5** | " |
| | 40% Vol Recovery | | **71.4** | " |
| | 50% Vol Recovery | | **88.9** | " |
| | 60% Vol Recovery | | **141.5** | " |
| | 70% Vol Recovery | | **167.1** | " |
| | 80% Vol Recovery | | **197.4** | " |
| | 85% Vol Recovery | | **212.4** | " |
| | 90% Vol Recovery | | **228.0** | " |
| | 95% Vol Recovery | | **241.1** | " |
| | FBP | | **244.8** | " |

FIG. 7

METHOD FOR PRODUCING FUEL FROM PLASTIC OR RUBBER WASTE MATERIAL

BACKGROUND OF THE INVENTION

Plastic is a material typically formed of long chain organic polymers. Because of the relatively low cost of production and ease of manufacture, plastic materials are used in a wide variety of products around the world, including many disposable products such as packaging. As consumption of disposable products formed of plastic materials increases, the associated waste plastic material also increases, leading to environmental concerns due to the long life of the plastic materials. Other issues associated with the dumping of waste plastic include soil contamination and infertility. An alternative to landfill disposal of plastic is incineration. However, this has posed problems such as damage to the furnace and the emission of harmful gases and an offensive odor. Society's ever-increasing environmental consciousness has deemed incineration a largely unpopular and unsustainable method of disposing of waste plastic.

Plastic recycling is the process of recovering scrap or waste plastic and reprocessing the material into useful products. However, unlike metal recycling, the recycling of plastic materials is challenging due to low economic returns. Recycling of plastic further faces difficulties because of the chemical nature of the long chain organic polymers. Furthermore, waste plastic materials often need sorting into the various plastic resin types, e.g. polyethylene terephthalate (PET), high-density polyethylene (HDPE), polyvinyl chloride (PVC), for separate recycling treatments.

As plastics are formed of long chain organic polymers containing hydrogen and carbon, processes have been developed for the conversion of the long chain polymer into shorter length hydrocarbon fuel products such as petrol or diesel. These processes typically involve pyrolysis of the plastic material to reduce the long-chain polymers to polymers of smaller chain length. Current techniques for processing plastic materials into hydrocarbon fuel products often result in the production of wax and tar type products that can foul equipment and piping used in the process. In addition, the presence of particulate materials introduced to the system or formed during the reaction result in the formation of a low purity, difficult to handle sludge-like products when condensed. Furthermore, hydrocarbons condensed directly after the pyrolysis reaction are generally required to be re-heated to separate out the desired hydrocarbons.

In view of these circumstances, various attempts have recently been made to reuse plastic waste as resources. Pyrolysis is a thermochemical decomposition of organic material, such as plastic, at elevated temperature in the absence of oxygen. It involves the simultaneous change of chemical composition and physical phase and is irreversible. Pyrolysis typically occurs at temperatures in the range of 400° C.-900° C., at small excess pressure. This process, for example, is widely used in petroleum refinery for obtaining low molecular monomers from naphtha, and it can be used for waste plastic processing with fuels production as an alternative of its incineration or landfilling.

In this process, the long polymer molecules of plastic materials are broken down into shorter chains of hydrocarbons with the help of heat and pressure. Essentially, the process mimics nature in which organic materials are broken down into oil over thousands or even millions of years. The pyrolysis process achieves this with intense heat in a closed, anaerobic system over a short period. A catalyst can be used to lower the temperature and increase the yield. Other substances which can be pyrolyzed are biomass, waste tires, lubricating oils, coal and petroleum residues; waste tire pyrolysis being the most popular and the most profitable of them all. However, this process requires huge investment, incurs abundant waste of energy and waste products, and selected type of plastics are separately processed.

Therefore, there exists a need for an efficient, eco-friendly and cost-effective method for producing fuels such as solid fuel and liquid fuel from a waste material such as rubber or plastic waste.

SUMMARY OF THE INVENTION

The present invention discloses a method for producing fuels such as liquid and solid fuels from a waste material comprising rubber or plastic waste. In an embodiment, the method comprises the steps of: (a) grinding said waste material into chips or flakes, (b) transferring the chips or flakes via a transmission system to a viscous fluid disorder tank, (c) introducing a catalyst to the transferred chips or flakes in the tank, (d) heating the chips or flakes with catalyst using a heating jacket or a coil in a reservoir of the tank at a predetermined temperature, (e) mixing the molten chips or flakes with catalyst using a helical butterfly stirrer inside the reservoir at a predetermined time and temperature to decompose the waste material, and (f) filtering the decomposed waste material to produce the fuel. In one embodiment, the decomposed waste material is transferred via a pipeline to a separating filter for producing the fuel.

In one embodiment, the method further comprises a separator to separate the output fuel into solid fuel and liquid fuel respectively. The liquid fuel is further transferred to a distillation tower to provide heavy liquid fuel and light liquid fuel separately. In some embodiments, the distillation tower is a heavy hydrocarbon distillation tower. In one embodiment, the density of the obtained light liquid fuel is 0.740-0.790, and the density of the obtained heavy liquid fuel is 0.810-0.850.

In one embodiment, the weight ratio percentage of waste material to the catalyst in the reservoir is 60% and 40% respectively. In one embodiment, the range of predetermined temperature of the tank for heating the chips or flakes with catalyst is maintained from 100° C. to 200° C. In one embodiment, the predetermined time for mixing the molten chips or flakes with catalyst inside the reservoir is 30 minutes.

In some embodiments, the catalyst is a combination of ten types of organic and inorganic chemicals. In one embodiment, the catalyst is configured to break the carbon-carbon bond in the waste material. In one embodiment, the catalyst reacts with the waste material to provide different characteristics of heavy liquid fuel, light liquid fuel and solid fuel. In one embodiment, the reservoir of the tank comprises lime to prevent release of toxic gases. In one embodiment, the reservoir of the tank further comprises an amphoteric material.

In one embodiment, the catalyst comprises calcium oxide, calcium carbonate, alcohol, mesitylene ($C_9H_{12}$), p-xylene $C_6H_4(CH_3)_2$, cumene hydroperoxide ($C_9H_{12}O_2$), tricarbonyl (methylcyclopentadienyl) manganese, propylene benzene, reformate, and isobutanol ($C_4H_{10}O$). In another embodiment, the catalyst comprises calcium oxide and calcium carbonate.

In yet another embodiment, the catalyst consists of calcium oxide, calcium carbonate, alcohol, mesitylene ($C_9H_{12}$), p-xylene $C_6H_4(CH_3)_2$, cumene hydroperoxide ($C_9H_{12}O_2$), tricarbonyl(methylcyclopentadienyl) manganese, propylene benzene, reformate, and isobutanol ($C_4H_{10}O$). In one example, the catalyst comprises 10 substances and all 10 are necessary for the catalyst to work; these ten substances are calcium oxide, calcium carbonate, alcohol, mesitylene ($C_9H_{12}$), p-xylene $C_6H_4(CH_3)_2$, cumene hydroperoxide ($C_9H_{12}O_2$), tricarbonyl(methylcyclopentadienyl) manganese, propylene benzene, reformate, and isobutanol ($C_4H_{10}O$). In another embodiment of the present invention, the catalyst comprises 3% calcium oxide, 2% calcium carbonate, 20% alcohol, 10% mesitylene, 7% p-xylene, 5% cumene hydroperoxide, 5% tricarbonyl (methylcyclopentadienyl) manganese, 3% propylene benzene, 40% reformate, and 5% isobutanol. Total reformate is 47% when 7% p-xylene is added to 40% reformate. Total alcohol is 25% when 5% isobutanol is added to 20% alcohol. Percentages stated are mass percentages.

Other objects, features and advantages of the present invention will become apparent from the following detailed description. It should be understood, however, that the detailed description and the specific examples, while indicating specific embodiments of the invention, are given by way of illustration only, since various changes and modifications within the spirit and scope of the invention will become apparent to those skilled in the art from this detailed description.

BRIEF DESCRIPTION OF DRAWINGS

FIG. 6 is test results of fuel extracted from the plastic waste material on catalytic reaction, according to an embodiment of the present invention; and FIG. 7 is test results of fuel extracted from the plastic waste material on catalytic reaction, according to an embodiment of the present invention.

DETAILED DESCRIPTION

A description of embodiments of the present invention will now be given with reference to the figures. It is expected that the present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

The present invention generally relates to a method for producing fuels such as liquid and solid fuels from a waste material comprising rubber or plastic waste.

The present invention discloses a method for producing fuels such as liquid and solid fuels from a waste material comprising rubber or plastic waste. Further, any type of plastic or rubber material is decomposed completely by a catalytic process. Said catalytic process breaks the polymeric chain and converts the waste material into useful fuel products. After conversion, the catalyst also helps in converting the product into a variety of heavy-duty liquid fuels and solid fuel. Further, the catalytic process is contamination-free, economical, and efficient in the production of liquid fuel and solid fuel.

Figure 1:
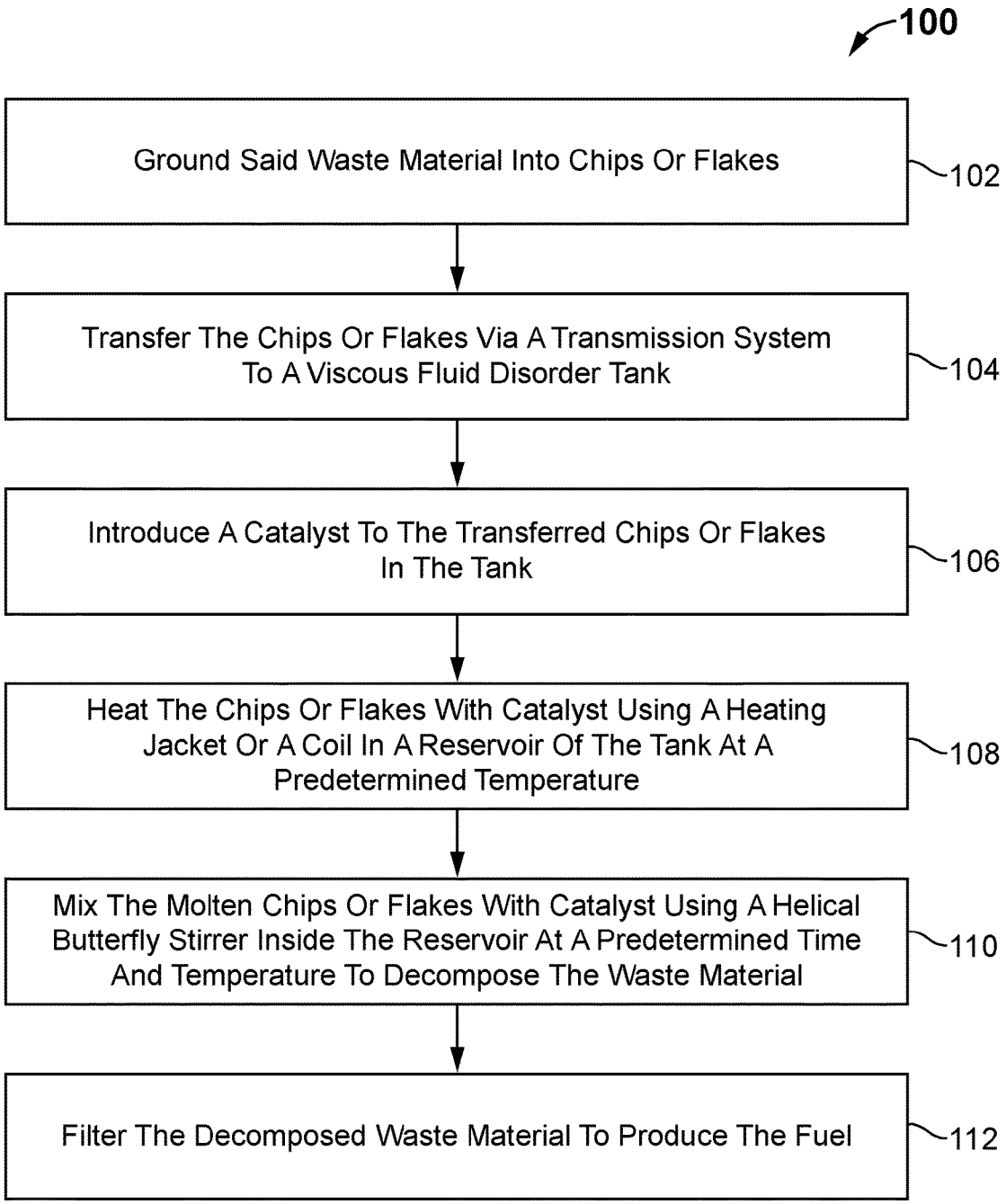
FIG. 1 exemplarily illustrates a method for producing fuels such as liquid and solid fuels from a waste material comprising rubber or plastic waste, according to an embodiment of the present invention.
Figure 2:
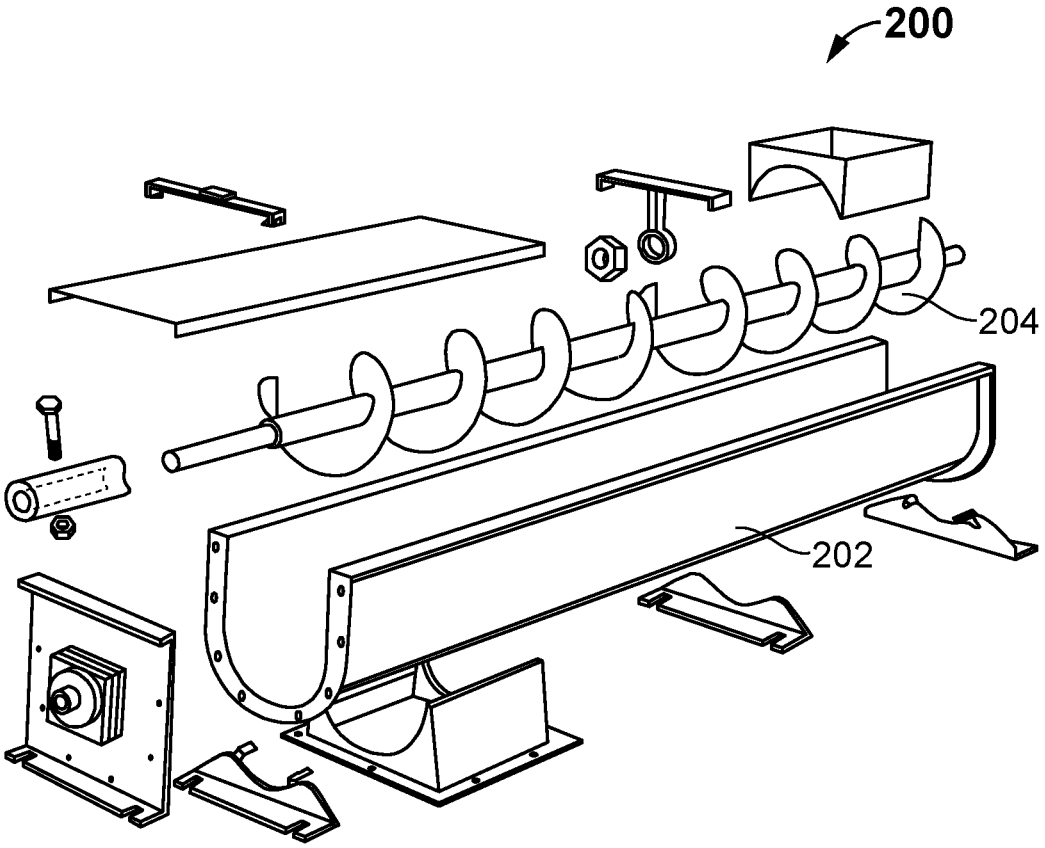
FIG. 2 is an exploded view of the viscous fluid disorder tank used for producing fuels from a waste material comprising rubber or plastic waste, according to an embodiment of the present invention.

Referring to FIG. 1, a method 100 for producing fuels such as liquid and solid fuels from a waste material comprising rubber or plastic waste is illustrated. In an embodiment, the method 100 comprises, grinding said waste material into chips or flakes at step 102. At step 104, the chips or flakes is transferred via a transmission system to a viscous fluid disorder tank 200, as shown in FIG. 2. At step 106, a catalyst is introduced into the transferred chips or flakes in a reservoir 202 of the tank 200. The method 100 according to the present invention, further comprises, heating the chips or flakes with the catalyst using a heating jacket or a coil in the reservoir 202 of the tank 200 at a predetermined temperature at step 108.

Figure 3:
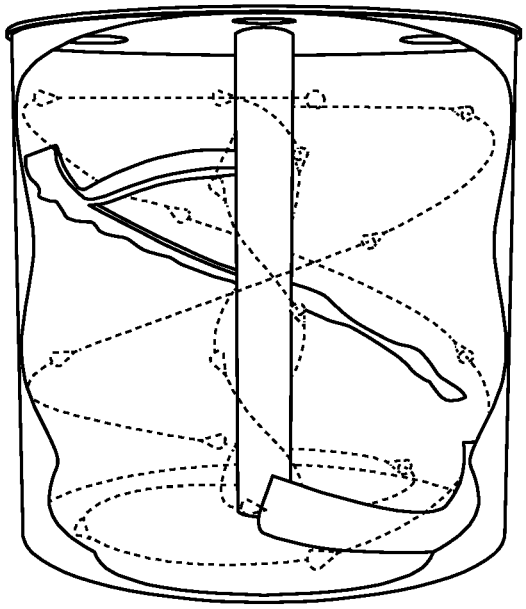
FIG. 3 exemplarily illustrates a mixer mechanism for mixing viscous materials with a helical butterfly stirrer incorporated inside the tank, according to an embodiment of the present invention.

At step 110, the heated or molten chips or flakes are mixed with the catalyst using a helical butterfly stirrer 204 inside the reservoir 202 at a predetermined time and temperature to decompose the waste material. The helical butterfly stirrer 204 starts to rotate in the direction or axial to the direction of the shaft, which helps in combining or mixing all the materials in the reservoir 202 together i.e., two liquid phases, solid phase, catalyst, and waste material such as rubber, plastic or combined. FIG. 3 exemplarily illustrates a mixer mechanism for mixing viscous materials with a helical butterfly stirrer incorporated inside the tank. At step 112, the decomposed waste material is filtered to produce the fuel. In some embodiments, all plastic or rubber waste materials are completely decomposed, and transparent liquid fuels remains intact.

Figure 4A:
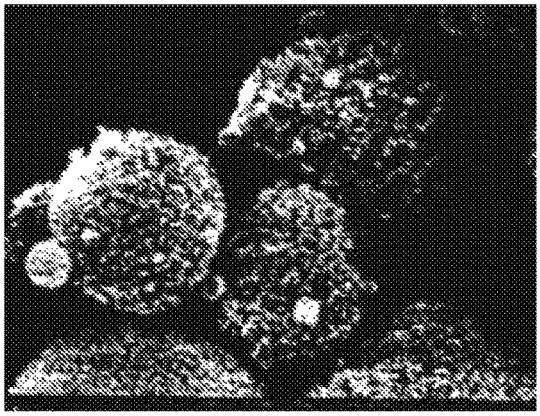
FIG. 4A and FIG. 4B is a microscopic image of plastic waste material at 60° C. showing breakdown of plastic waste material chain using the catalyst.
Figure 4B:
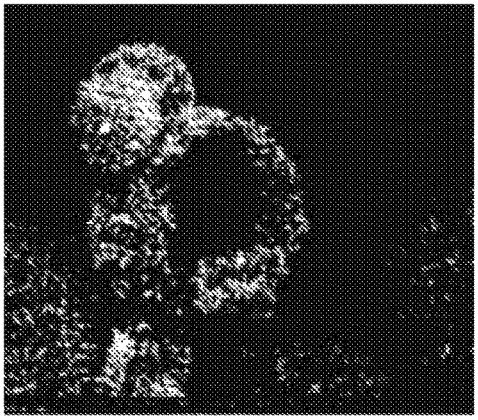
Figure 5A:
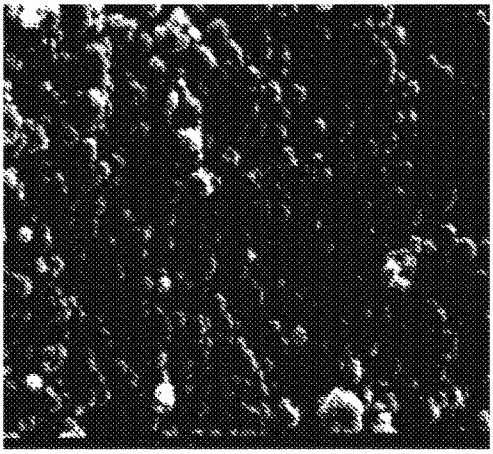
FIG. 5A and FIG. 5B is a microscopic image of plastic waste material showing breakdown of its long carbon chain.
Figure 5B:
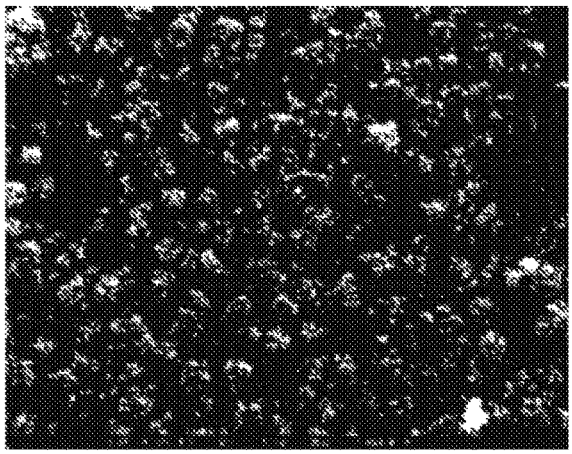

FIG. 4A and FIG. 4B is a microscopic image of plastic waste material at 60° C. showing breakdown of plastic waste material chain using the catalyst. FIG. 5A and FIG. 5B is a microscopic image of plastic waste material showing breakdown of its long carbon chain. In one embodiment, the catalytic process undergoes a primary and secondary reaction. In primary reaction, the carbon-carbon bond of the waste material is broken. In secondary reaction, the catalyst reacts to the waste materials to produce a variety of heavy and light liquid fuel, and solid fuel. According to the present invention, the catalyst is self-consumable, which results in the breakdown of carbon bonds.

The primary product after the combination in a viscous tank 200 is transported through the pipelines through a separating filter, so that non-plastic materials or liquid product obtained as the liquid fuel. Then, it is transferred to the separator to separate solid fuel and separate from other liquid materials. Further, the liquid fuel is transferred to the heavy hydrocarbon distillation tower to separate heavy and light fuels. In one embodiment, the decomposed waste material is transferred via a pipeline to a separating filter for producing the fuel. This process is economical and produces different characteristics of fuels without any residue or waste at the end of the process.

$(C_2H_3Cl)_n)+(C_3H_6)_n)+C_8H_8)_n)+CH_2—CH(CH_3)]_n]+CH_2O)_n)+(CH_2)5C(O)NH)$+Catalytic (P)=Liquid fuels and Solid fuels (Product)

In one embodiment, the method further comprises a separator to separate the output fuel into solid fuel and liquid fuel respectively. The liquid fuel is further transferred to a distillation tower to provide heavy liquid fuel and light liquid fuel separately. In some embodiments, the distillation tower is a heavy hydrocarbon distillation tower. In one embodiment, the density of the obtained light liquid fuel is 0.740-0.790, and the density of the obtained heavy liquid fuel is 0.810-0.850.

In one embodiment, the weight ratio percentage of waste material to the catalyst in the reservoir 202 is 60% and 40% respectively. For example, to produce a ton of fuel, 400 kg of catalyst is added for 600 kg of plastic waste in the tank 200. In one embodiment, the range of predetermined temperature of the tank 200 for heating the chips or flakes with catalyst is maintained from 100° C. to 200° C. The temperature of the reservoir 202 is initially maintained at 100° C. and slowly increased to a maximum temperature of 200° C., kept as a constant temperature. At the same time, the mixing of the material continues. In one embodiment, the predetermined time for mixing the molten chips or flakes with catalyst inside the reservoir 202 is 30 minutes.

In some embodiments, the catalyst is a combination of ten types of organic and inorganic chemicals. In one embodiment, the catalyst is configured to break the carbon-carbon bond in the waste material. In one embodiment, the catalyst reacts with the waste material to provide different characteristics of heavy liquid fuel, light liquid fuel and solid fuel. In one embodiment, the reservoir 202 of the tank 200 comprises lime to prevent release of toxic gases. The lime is pre-planted in the tank 200 to prevent the release of toxic gases during this atmospheric operation.

In one embodiment, the reservoir 202 of the tank 200 further comprises an amphoteric material. One of the amphoteric material is in the reservoir 202, and the other substance prevents the production of toxic gases, and other materials break down the bond of plastic and tires. Product are, liquid fuel, which are separated into two rows as heavy and light liquid fuel, and solid fuels with high viscosity and long carbon bonds.

FIG. 6 and FIG. 7 is test results of fuel extracted from the plastic waste material on catalytic reaction, according to an embodiment of the present invention. In some embodiments, heavy liquid fuels have a density between 0.8119 to 0.8560, and low ash content (0.03%). The other advantages of this fuel are the cloudiness or freezing (pour point) at a temperature of −10° C. It is up to −22° C., its global scale is −8° C. and its carbon residue is 0.065, the global value is at most 0.1 and its carbon sufficiency is between carbon 7 and carbon 28.

The fuel is good quality, compared to the standard existing fuel. Light liquid fuel is separated from heavy liquid fuel after distillation and has a carbon content ranges from of 5 to 15, and octane number is 94 and distillation is 42.7 to 214.8. This analysis is done without adding other additives. Solid fuel extracted from the waste material, according to the present invention, has a thermal value of 947° C. The carbon content ranges from 9 to 36, and its ash remains is 0.007 percent. Solid fuel is solid and gelatinous. Solid fuel could be used by factories and ships and furnaces, as well as in a variety of mills and gasoline operated plants. This fuel type is not pollutant and has a very high economic value. Due to its high thermal value, this fuel does not burn quickly and ignites at a rate of 2 grams for 30 minutes.

According to the present invention, the conversion rate of the input waste materials for processing is 100%. For example, 50% light liquid fuel is produced in a volume of one ton of finished product, 500 Kg at the end of the process, light diesel fuel is produced at a density of 0.740. 30% of heavy fuel oil is produced in the volume of one ton of the final product, 300 Kg at the end of the process of heavy liquid fuel production with a density (0.810-0.850). 20% solid fuel is produced in a tonnes of final product, equivalent to 200 Kg at the end of the solid fuel process.

The advantage of the present invention is that all composition, parts, devices, and technology, are used for complete decomposition of plastic or rubber waste material. Further, the chemical structure of all types of plastic and rubber waste is broken down and converted to petroleum derivatives. The method according to the present invention, does not produce environmental lesions and contaminated gases. In present invention, a variety of heavy and light fluid fuels are produced with the required percentages and qualities. Another advantage of this method is, entire process is done at the atmospheric condition and further no need for any distillation towers.

One aspect of the present disclosure is directed to a method for producing fuels from a waste material comprising rubber or plastic waste. The method comprises (a) grinding said waste material into chips or flakes, transferring the chips or flakes via a transmission system to a viscous fluid disorder tank, and introducing a catalyst to the transferred chips or flakes in the tank. The method further comprises heating the chips or flakes with catalyst using a heating jacket or a coil in a reservoir of the tank at a predetermined temperature, mixing the molten chips or flakes with the catalyst using a helical butterfly stirrer inside the reservoir at a predetermined time and temperature to decompose the waste material, and filtering the decomposed waste material to produce the fuel.

The method may further comprise a separator to separate the output fuel into solid fuel and liquid fuel respectively. The liquid fuel may further be transferred to a distillation tower to provide heavy liquid fuel and light liquid fuel separately. The distillation tower may be a heavy hydrocarbon distillation tower. The density of the light liquid fuel may be in the range of 0.740-0.790 kg/L. The density of the heavy liquid fuel may be in the range of 0.810-0.850 kg/L. The weight ratio percentage of waste material to the catalyst in the reservoir is 60% and 40% respectively.

The predetermined temperature of the tank in step (d) can range from 100° C. to 200° C. The predetermined time for mixing done at step (e) is about 30 minutes. In one example, the catalyst is a combination of ten types of organic and inorganic chemicals. The catalyst may be configured to break the carbon-carbon bond in the waste material. The catalyst can react with the waste material to provide different characteristics of heavy liquid fuel, light liquid fuel and solid fuel. The reservoir of the tank may comprise lime to prevent release of toxic gases. The reservoir of the tank may further comprise an amphoteric material. In another example of the presently disclosed method, the decomposed waste material is transferred via a pipeline at step (f) to a separating filter for producing the fuel.

In one embodiment, the catalyst comprises calcium oxide, calcium carbonate, alcohol, mesitylene ($C_9H_{12}$), p-xylene $C_6H_4(CH_3)_2$, cumene hydroperoxide ($C_9H_{12}O_2$), tricarbonyl (methylcyclopentadienyl) manganese, propylene benzene, reformate, and isobutanol ($C_4H_{10}O$). In another embodiment, the catalyst comprises calcium oxide and calcium carbonate. In yet another embodiment, the catalyst consists of calcium oxide, calcium carbonate, alcohol, mesitylene ($C_9H_{12}$), p-xylene $C_6H_4(CH_3)_2$, cumene hydroperoxide ($C_9H_{12}O_2$), tricarbonyl(methylcyclopentadienyl) manganese, propylene benzene, reformate, and isobutanol ($C_4H_{10}O$).

It is believed that the calcium oxide prevents the formation of toxic gases in the reservoir during the process of conversion of plastics and rubber into fuel. The calcium carbonate is able to adjust the PH and reduce the required process temperature. Calcium oxide and calcium carbonate are important features of the catalyst and in this process. Together, these and also the complete catalyst mix do not produce toxic substances and makes the process easier than any existing process. The rest of the material starts after putting into the tank and combining them with minerals and mixing and starting to raise the temperatures up to 100 C. This then starts and accelerates the breakdown of the long chain of rubber and plastics.

In one example, the catalyst comprises 10 substances and all 10 are necessary for the catalyst to work. These ten items that comprise the catalyst include calcium oxide, calcium carbonate, alcohol, mesitylene (C9H12), p-xylene C6H4 (CH3)2, cumene hydroperoxide (C9H12O2), tricarbonyl (methylcyclopentadienyl) manganese, propylene benzene, reformate, and isobutanol (C4H10O). In one example, each of them is in plastics and rubber decomposition and fuel production.

The existing technology for achieving a similar outcome, is more costly and uses solvents and fails to decompose plastics and rubber and covert it to fuel. In contrast, the presently disclosed method using the catalyst produces high quality fuel, making the process easy and also it produces light and heavy carbon and solid fuel fuels. Whereas in the past, most polymer units were either thermal or pyrolyzed, here, the presently disclosed method uses only a catalytic method, and this catalyst prevents the formation of toxins and completely decomposes the polymer. Using the presently disclosed process, high-quality fuel products are produced and ultimately the waste is not produced. The presently disclosed method allows for the production of solid fuel after breaking the polymers. This material is created after the composition amphoteric in the system and prevents the corrosion of the parts.

In one example, heavy liquid fuels have a density between 0.8119 to 0.8560 kg/L, and it, has a low 0.03 percent ash content. Another advantage of this fuel is the cloudiness or freezing (pour point) of it at a temperature of −10° C. to −22° C., its global scale is −8 and its carbon residue is 0.065 (see e.g. FIG. 6). The global value was at most 0.1 and its carbon sufficiency is between carbon 7 and carbon 28. So this fuel is good and of excellent quality. This analysis (e.g. FIG. 6) is the primary product of separation after the addition of a catalyst, without product quality and without distillation. Therefore, after standardization of this product, its quality can be higher than international standards.

In one example, light liquid fuel is separated from heavy liquid fuel after distillation and has a carbon content of between 5 and 15 carbon, and its octane number is 94 and the boiling points of the components of this light fuel range between 42.7° C. to 214.8° C. This analysis is without adding other additives. But it can be used to disperse the carbon content heavier after distillation.

Solid fuel is a fuel that has been invented in this process and is separated from the original product. This fuel has a thermal value of 947° C. The carbon content of carbon is from 9 to carbon to 36, and its ash remains is 0.007 percent (e.g. see FIG. 7). This fuel is solid and gelatinous. Solid fuel is available for use by factories and ships and furnaces, as well as in a variety of mills and gasoline operated plants. Two tests of ash content and thermal value were taken. This fuel is not pollutant and has a high economic value. Due to its high thermal value, this fuel does not burn quickly and ignites it at 2 grams for 30 minutes.

In one example, the percentage of catalyst used is based on weight or by volume percentage, and can include CaO, $CaCO_3$, alcohol, mesitylene ($C_9H_{12}$), p-xylene, cumene hydroperoxide ($C_9H_{12}O_2$), tricarbonyl(methylcyclopentadienyl) manganese, propylene benzene, reformate, and isobutanol ($C_4H_{10}O$). In one example which is the fabrication of 100 kg of the catalyst, the weight ratio percentage of waste material to the catalyst in the reservoir 202 is 60% and 40% respectively. In this example, the catalyst includes: 3% of calcium oxide, 2% of calcium carbonate, 20% alcohol, 10% mesitylene ($C_9H_{12}$), 7% p-xylene, 5% cumene hydroperoxide ($C_9H_{12}O_2$), 5% tricarbonyl (methylcyclopentadienyl) manganese, 3% propylene benzene, 40% reformate, and 5% isobutanol ($C_4H_{10}O$). Total reformate is 47% when 7% p-xylene is added to 40% reformate. Total alcohol is 25% when 5% isobutanol is added to 20% alcohol. Percentages stated are mass percentages.

In one example, first 3 kg of calcium oxide and 4 kg calcium carbonate are poured into the tank, then combine the ingredients together. Next, the mixer was used to mix all the ingredients in the tank. The temperature was then raised and after mixing at the temperature to 100 C rubber waste and plastics were added. At this stage, plastics and rubber waste are completely mixed with the materials. After about 30 minutes, plastics and rubber waste were broken down. In the final stage, after the breakdown, the materials become light and heavy fuels and solid fuels. Liquid fuels dispatched to distillation to be separated. These materials are together highly desirable and provide powerful means to break the plastics and rubber waste and convert it to a variety of fuel types.

The foregoing description comprise illustrative embodiments of the present invention. Having thus described exemplary embodiments of the present invention, it should be noted by those skilled in the art that the within disclosures are exemplary only, and that various other alternatives, adaptations, and modifications may be made within the scope of the present invention. Merely listing or numbering the steps of a method in a certain order does not constitute any limitation on the order of the steps of that method.

Many modifications and other embodiments of the invention will come to mind to one skilled in the art to which this invention pertains having the benefit of the teachings presented in the foregoing descriptions. Although specific terms may be employed herein, they are used only in generic and descriptive sense and not for purposes of limitation. Accordingly, the present invention is not limited to the specific embodiments illustrated herein. While the above is a complete description of the preferred embodiments of the invention, various alternatives, modifications, and equivalents may be used. Therefore, the above description and the examples should not be taken as limiting the scope of the invention, which is defined by the appended claims

The invention claimed is:

1. A method for producing fuels from a waste material comprising rubber or plastic waste, comprising the steps of:

(a) grinding said waste material into chips or flakes;

(b) transferring the chips or flakes via a transmission system to a viscous fluid disorder tank;

(c) introducing a catalyst to the transferred chips or flakes in the tank;

(d) heating the chips or flakes with catalyst using a heating jacket or a coil in a reservoir of the tank at a predetermined temperature to form molten chips or flakes;

(e) mixing the molten chips or flakes with catalyst using a helical butterfly stirrer inside the reservoir at a predetermined time and temperature to decompose the waste material, and (f) filtering the decomposed waste material to produce the fuels;

wherein the catalyst comprises calcium oxide, calcium carbonate, alcohol, mesitylene, p-xylene, cumene hydroperoxide, tricarbonyl(methylcyclopentadienyl) manganese, propylene benzene, reformate, and isobutanol.

2. The method of claim 1, wherein the catalyst consists of calcium oxide, calcium carbonate, alcohol, mesitylene, p-xylene, cumene hydroperoxide, tricarbonyl(methylcyclopentadienyl) manganese, propylene benzene, reformate, and isobutanol.

3. The method of claim 1, wherein the catalyst comprises 3% calcium oxide, 2% calcium carbonate, 20% alcohol, 10% mesitylene, 7% p-xylene, 5% cumene hydroperoxide, 5% tricarbonyl(methylcyclopentadienyl) manganese, 3% propylene benzene, 40% reformate, and 5% isobutanol, wherein the percentages stated are mass percentages.

* * * * *